US009510621B2

(12) United States Patent
Ono

(10) Patent No.: US 9,510,621 B2
(45) Date of Patent: Dec. 6, 2016

(54) CIGARETTE AND PRODUCTION METHOD THEREOF

(71) Applicant: JAPAN TOBACCO INC., Tokyo (JP)

(72) Inventor: Hiroyoshi Ono, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 773 days.

(21) Appl. No.: 13/827,536

(22) Filed: Mar. 14, 2013

(65) Prior Publication Data

US 2013/0199550 A1 Aug. 8, 2013

Related U.S. Application Data

(63) Continuation of application No. PCT/JP2011/062814, filed on Jun. 3, 2011.

(30) Foreign Application Priority Data

Oct. 15, 2010 (JP) ..... 2010-232574

(51) Int. Cl.
*A24D 1/04* (2006.01)
*A24C 5/47* (2006.01)
*A24D 1/02* (2006.01)

(52) U.S. Cl.
CPC ..... *A24D 1/045* (2013.01); *A24C 5/472* (2013.01); *A24D 1/02* (2013.01)

(58) Field of Classification Search
None
See application file for complete search history.

(56) References Cited

U.S. PATENT DOCUMENTS

| | | | | |
|---|---|---|---|---|
| 2,904,050 | A * | 9/1959 | Kiefer | A24D 3/10 131/342 |
| 3,339,558 | A * | 9/1967 | Waterbury | A24D 3/061 131/335 |
| 3,390,686 | A * | 7/1968 | Irby, Jr. | A24D 3/061 131/337 |
| 5,662,126 | A | 9/1997 | Charlton et al. | |
| 6,750,897 | B1 | 6/2004 | Moshrefi et al. | |
| 2005/0066981 | A1 | 3/2005 | Crooks et al. | |
| 2006/0137700 | A1 | 6/2006 | Gong et al. | |
| 2008/0029111 | A1 | 2/2008 | Dube et al. | |

(Continued)

FOREIGN PATENT DOCUMENTS

| | | |
|---|---|---|
| EA | 200501915 A1 | 6/2007 |
| JP | 60-041197 U | 3/1985 |

(Continued)

OTHER PUBLICATIONS

Rejection Decision issued May 29, 2015, in Russian Patent Application No. 2013116981, with English translation.

(Continued)

*Primary Examiner* — Michael J Felton
(74) *Attorney, Agent, or Firm* — Birch, Stewart, Kolasch & Birch, LLP

(57) ABSTRACT

A cigarette comprising a tobacco rod comprising a tobacco filler and a cigarette paper which is wrapped around the tobacco filler, a filter comprising a filter member and a filter wrapping paper which is integrally wrapped around the filter member, and a tipping member which is bonded onto the tobacco rod and the filter with a pressure-sensitive adhesive to connect the tobacco rod and the filter.

6 Claims, 3 Drawing Sheets

(56) References Cited

U.S. PATENT DOCUMENTS

| | | | |
|---|---|---|---|
| 2010/0108084 | A1 | 5/2010 | Norman et al. |
| 2010/0255253 | A1 | 10/2010 | Kishioka |

FOREIGN PATENT DOCUMENTS

| | | | |
|---|---|---|---|
| JP | 4-267871 | A | 9/1992 |
| JP | 2000-192003 | A | 7/2000 |
| JP | 2007-507230 | A | 3/2007 |
| JP | 2009-545324 | A | 12/2009 |
| JP | 2010-232574 | A | 10/2010 |
| WO | WO 02/00045 | A1 | 1/2002 |
| WO | WO 2009/080604 | A1 | 7/2009 |

OTHER PUBLICATIONS

English translation of International Preliminary Report on Patentability issued Apr. 18, 2013, in PCT International Application No. PCT/JP2011/062814.
International Search Report issued in PCT/JP2011/062814, mailed on Sep. 13, 2011.
Official Action issued Aug. 25, 2014, in Russian Patent Application No. 2013116981, with English translation.

* cited by examiner

CIGARETTE AND PRODUCTION METHOD THEREOF

CROSS REFERENCE TO RELATED APPLICATIONS

This application is a Continuation Application of PCT Application No. PCT/JP2011/062814, filed Jun. 3, 2011 and based upon and claiming the benefit of priority from prior Japanese Patent Application No. 2010-232574, filed Oct. 15, 2010, the entire contents of all of which are incorporated herein by reference.

BACKGROUND OF THE INVENTION

1. Field of the Invention

The present invention relates to a cigarette in which a tipping member is bonded with a pressure-sensitive adhesive, and a production method thereof.

2. Description of the Related Art

In a filter-tipped cigarette which is commercially available at present, a tobacco rod is connected to a filter by sticking a tipping paper thereon with a heat-sensitive or solvent-evaporative paste. For that reason, when the tipping paper is stuck with the paste in a cigarette rolling process, the process requires a step of transferring the paste to the tipping paper and a step of drying the paste by heating it with a heater.

The heater of a cigarette rolling machine has a temperature of approximately 80 to 240° C., and if mechanical trouble occurs, products in process and materials stay around the heater, and thus they are heated to a temperature almost the same as the heater temperature.

Thus, if a substance unstable to the heat-sensitive or solvent-evaporative paste, such as a water-soluble substance, or a thermal decomposing or denaturing substance, is incorporated into the filter-tipped cigarette, the substance cannot be stably maintained, and thus a problem arises in which it adheres in the vicinity of the heater. For example, a cellulose material such as cellophane, which is used as a transparent tipping paper, is unstable to the heat-sensitive or solvent-evaporative paste, and a capsule, which is used as a flavor-containing capsule, is unstable to heat or a surfactant contained in the paste.

On the other hand, the paste used for pasting the tipping paper has been improved in this technical field. For example, Patent Document 1 discloses a vinyl acetate resin emulsion type of solvent-evaporative paste having excellent initial adhesiveness; Patent Document 2 discloses a heat-sensitive paste which is melted by heat having a low temperature; and Patent Document 3 discloses a heat-sensitive paste having resistance to triacetin. In addition, Patent Document 4 discloses that a tobacco is connected to a tobacco filter by use of a cellophane tape instead of a tipping paper.

PRIOR ART DOCUMENT

Patent Document

Patent Document 1: Jpn. Pat. Appln. KOKAI Publication No. 2000-192003

Patent Document 2: International Publication No. 02/00045

Patent Document 3: U.S. Patent Application Publication No. 2006/0137700

Patent Document 4: Jpn. UM Appln. KOKAI Publication No. 60-41197

BRIEF SUMMARY OF THE INVENTION

Problem to be Solved by the Invention

The present inventor has confirmed by experiments that when slurry of a gelatin microcapsule, which is used as a flavor-containing capsule, is put on a slide glass and is heated, it starts to melt at 110° C., and is completely melted and turns brown at 210° C. Further, the present inventor has confirmed by experiments that when the slurry of the gelatin microcapsule is applied to a paper sheet and is heated to 180° C., it turns brown. That is, the present inventor has found that if a heat-unstable substance such as a gelatin microcapsule is subjected to a heating step according to a conventional method of producing a cigarette, the contents of the capsule may be possibly leached out, with this possibility being high in case of mechanical trouble.

In view of the problems and background arts described above, it is an object of the present invention to provide a cigarette into which a material unstable to a heat-sensitive or solvent-evaporative paste or a thermal decomposing or denaturing material can be stably incorporated, and a production method thereof.

Means for Solving the Problem

According to the present invention, there is provided a cigarette comprising a tobacco rod comprising a tobacco filler and a cigarette paper which is wrapped around the tobacco filler; a filter comprising a filter member and a filter wrapping paper which is integrally wrapped around the filter member; and a tipping member which is bonded onto the tobacco rod and the filter with a pressure-sensitive adhesive to connect the tobacco rod and the filter.

In the cigarette of the present invention, a material having a melting point of 240° C. or less may be used as the tipping member. The cigarette of the present invention may further comprise a flavor-containing capsule in the filter or on the tipping member.

Further, according to the present invention, there is provided a method for producing the above-mentioned cigarette, which comprises preparing a tipping member which comprises a pressure-sensitive adhesive and a release liner for protecting the pressure-sensitive adhesive, on the back surface of the tipping member; exposing the pressure-sensitive adhesive by releasing the release liner from the tipping member; cutting the pressure-sensitive adhesive-exposed tipping member into a size suitable for rolling the cigarette; and wrapping the tobacco rod and the filter in the cut tipping member to connect them.

Effects of the Invention

In the cigarette of the present invention, the tipping member is bonded with the pressure-sensitive adhesive, and thus a heating procedure is not required in its production process, and a substance unstable to a heat-sensitive or solvent-evaporative paste or a heat-unstable substance can be stably incorporated therein. For example, a substance unstable to the heat-sensitive or solvent-evaporative paste or a thermal decomposing or denaturing material can be applied to the tipping member itself, or can be incorporated in the filter or attached on the surface of the tipping member, as a flavor-containing capsule.

The method for producing the cigarette of the present invention uses the tipping member having the pressure-sensitive adhesive on its back surface, and thus the method does not require a step of transferring the heat-sensitive or solvent-evaporative paste or a step of drying the paste. As a result, a substance unstable to the heat-sensitive or solvent-evaporative paste and the heat-unstable substance can be stably maintained.

DETAILED DESCRIPTION OF THE INVENTION

The present invention will be explained below with reference to drawings. The following explanations are intended to describe the present invention in detail, and are not intended to limit the present invention.

1. Cigarette

The cigarette of the present invention is characterized by bonding a tipping member with a pressure-sensitive adhesive.

Figure 1:
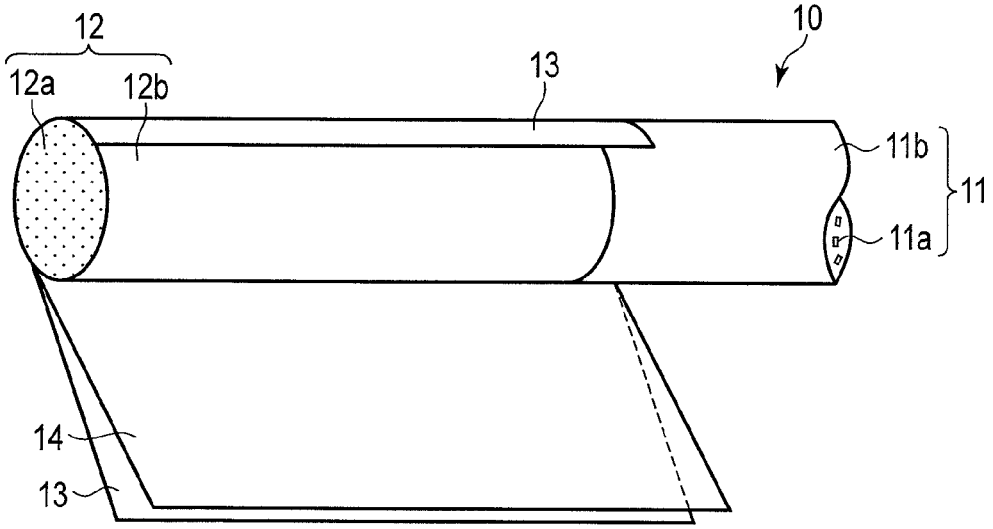
FIG. 1 is an exploded perspective view showing a part of a cigarette according to a first embodiment of the present invention.

FIG. 1 is an exploded perspective view showing a part of a cigarette according to a first embodiment of the present invention. A cigarette 10 shown in FIG. 1 comprises a tobacco rod 11 and a filter 12, and has a cylindrical shape as a whole, as a usual filter-tipped cigarette. The tobacco rod 11 and the filter 12 are connected to each other with a tipping member 13.

The tobacco rod 11 is formed of a tobacco filler 11*a* and a cigarette paper 11*b* which is wrapped around the tobacco filler, as a usual cigarette. The tobacco rod 11 may have, for example, a diameter of 5 to 10 mm and a length of 40 to 80 mm.

The filter 12 is located at one end of the tobacco rod 11, and is formed of a filter member 12*a* and a filter wrapping paper 12*b* which is wrapped around the filter member. The filter member 12*a* shown in FIG. 1 has a single filter structure, so-called a plain filter structure. The filter member 12*a* is constituted by a fibrous filter material such as cellulose acetate fiber, as a usual filter-tipped cigarette. The filter 12 has almost the same diameter as that of the tobacco rod 11, and may have a length of, for example, 15 to 40 mm, as a usual filter. The filter wrapping paper 12*b*, which is integrally wrapped around the filter member 12*a*, may have a thickness of 10 to 100 μm. The filter wrapping paper 12*b* may have air-permeability or may not, but an air-permeable paper is generally used.

The tipping member 13 is bonded to the entire filter wrapping paper 12*b* and a part of the cigarette paper 11*b* with a pressure-sensitive adhesive 14 so that it covers them. In the present specification, the tipping member 13 means a member having a function as a tipping paper which is generally used in a cigarette (i.e., a function of connecting a tobacco rod to a filter). In the present invention, any sheet formed from a polymer material can be used as the tipping member, in addition to a paper (i.e., a tipping paper), and thus the term "tipping member" is used instead of the term "tipping paper." The tipping member 13 may have, for example, a length (width) of 20 to 50 mm in an axial direction of the tobacco rod, and a thickness of 10 to 100 μm. The tipping member has a number of small apertures for air permeation (ventilation apertures) in a line or multiple lines along the circumferential direction of the cigarette, or irregularly, as a tipping paper used in a general filter-tipped cigarette.

The pressure-sensitive adhesive 14 is located on a back surface of the tipping member 13, and serves to paste the tipping member. The pressure-sensitive adhesive 14 has preferably a size to cover the entire back surface of the tipping member, but it is not necessary to have the size to cover the entire back surface of the tipping member 13, if it integrally bonds the tipping member 13 to the tobacco rod 11 and the filter 12. The pressure-sensitive adhesive 14 refers to an adhesive which exhibits adhesiveness by a pressing force alone, without a procedure of heating or solidification by drying. Commercial available double-sided adhesive tapes, preferably acrylic double-sided adhesive tapes and rubber double-sided adhesive tapes may be used as the pressure-sensitive adhesive 14. For example, an acrylic adhesive tape (No. 501 L) manufactured by Nitto Denko Corporation and a rubber adhesive tape (VR-5321) manufactured by Nitto Denko Corporation may be used.

Figure 2:
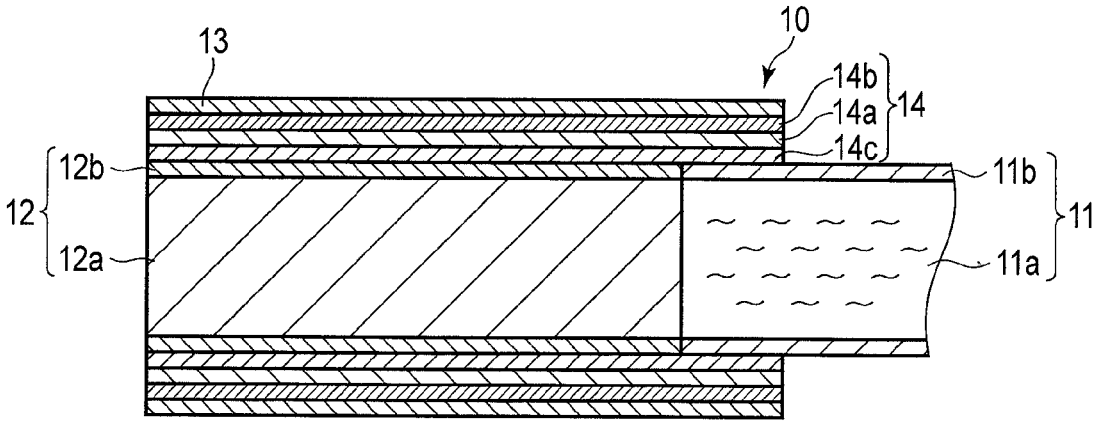
FIG. 2 is a cross-sectional view showing a part of a cigarette in the case where a pressure-sensitive adhesive having a three-layer structure is used.

Double-sided adhesive tapes are classified into two groups: double-sided adhesive tapes having a three-layer structure in which pressure-sensitive adhesive layers are provided on both surfaces of a substrate such as a nonwoven fabric or a polyester film, and double-sided adhesive tapes having a monolayer structure which has a pressure-sensitive adhesive layer alone having no substrate. In the present invention, both types of the double-sided adhesive tapes can be used. The above acrylic adhesive tape (No. 501 L) manufactured by Nitto Denko Corporation has a three-layer structure in which acrylic pressure-sensitive adhesive layers are provided on both surfaces of a nonwoven fabric (substrate). The above rubber adhesive tape (VR-5321) manufactured by Nitto Denko Corporation has a three-layer structure in which a rubber pressure-sensitive adhesive layer is provided on one surface of a polyester film (substrate) and an acrylic pressure-sensitive adhesive layer is provided on the other surface of the substrate. FIG. 2 shows a cross-sectional view showing a cigarette in the case of using a pressure-sensitive adhesive having such a three-layer structure (i.e., a substrate and pressure-sensitive adhesive layers on both surfaces thereof).

In FIG. 2, the same reference number is applied to an element corresponding to the element in FIG. 1. In a cigarette 10 shown in FIG. 2, a tobacco rod 11 and a filter 12 are connected to each other with a tipping member 13, and the tipping member 13 is bonded onto the tobacco rod 11 and the filter 12 with a pressure-sensitive adhesive 14. The pressure-sensitive adhesive 14 has a three-layer structure consisting of a substrate 14*a*, a first pressure-sensitive adhesive 14*b* which covers one surface of the substrate, and a second pressure-sensitive adhesive 14*c* which covers the other surface of the substrate.

The cigarette of the present invention having the pressure-sensitive adhesive with such a three-layer structure can have more improved wet breaking strength of the cigarette than conventional cigarettes in which the tipping paper is bonded using a heat-sensitive adhesive, owing to the presence of the substrate 14*a*. The term "wet breaking strength" means a nature of a cigarette to become easily broken at an abutted part of the tobacco rod and the filter, which is caused in a situation where a tipping paper becomes wet with saliva when a smoker puts the cigarette in his/her mouth, resulting in reduced strength of the tipping paper. In addition, the cigarette of the present invention having the pressure-sensitive adhesive with such a three-layer structure can have improved opacity of the tipping paper, which leads to improved cleanliness sense and high-grade sense of the cigarette.

In the cigarette of the present invention, the tipping member 13 is bonded with the pressure-sensitive adhesive 14, and thus a heating procedure is not required in its production process, and any material including a material unstable to a heat-sensitive or solvent-evaporative paste and a heat-unstable material can be used as the tipping member.

Specifically, in the present invention, any polymer material such as a plastic film can be used as the tipping member 13, in addition to a paper (i.e., a tipping paper). For example, polymer films shown in the following table can be used.

TABLE 1

| | Melting Point Tm [° C.] | Grass Transition Point Tg [° C.] |
|---|---|---|
| Polyethylene | 130 | −110, −20 |
| Polypropylene | 170 | −20 |
| Polybutylene Succinate | 114 | −32 |
| Polyhydroxybutyrate | 175 | 5 |
| Nylon-6 | 225 | 47 |
| Polystyrene | 230 | 100 |
| Polyethylene Terephthalate | 260 | 68, 81 |
| Nylon-66 | 267 | 49 |
| Polylactic Acid | 175 | 56 |

When a polymer material having a melting point of 240° C. or less, preferably a polymer material having a melting point of 200° C. or less, for example, polyethylene or polybutylene succinate having a melting point of 150° C. or less is used as the material for the tipping member, the effects of the present invention are remarkably exhibited among the polymer materials shown in the above table. In other words, even a polymer material having a melting point of 240° C. or less can be stably used as the tipping member material in the cigarette of the present invention, because the tipping member is bonded with the pressure-sensitive adhesive and thus a heating procedure is not required in its production process. On the other hand, if each polymer material shown in the above table is subjected to a heating step according to a conventional method, the temperature of the material reaches the melting point in a heater-temperature range, and thus it is very likely to adhere in the vicinity of the heater, especially in case of mechanical trouble.

As the polymer material, synthetic papers in which polyethylene or polypropylene is mixed with a colored powder (calcium carbonate), such as YUPO manufactured by Yupo Corporation or Keeplus manufactured by TBM Co., Ltd., may also be used.

In addition to the polymer materials shown in the above table, a cellulosic material film (for example, cellophane) or a plastic film, which is used as a transparent tipping paper in a cigarette, may be used as the tipping member. When the cellulosic material film is used, the effects of the present invention are remarkably exhibited. The cellulosic material is water-soluble substance, and thus is unstable to a heat-sensitive or solvent-evaporative paste. However, such a paste is not used in the present invention, and thus it is stably used as the material for the tipping member.

The cigarette of the present invention can further include a capsule containing a flavor component in a filter or on a tipping member. As the flavor component, for example, menthol or essential oil from plants can be used.

Figure 3:
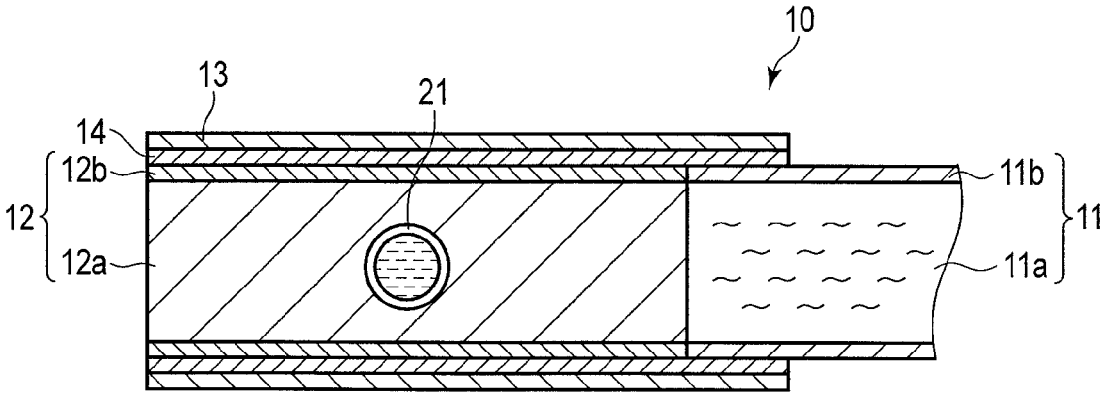
FIG. 3 is a cross-sectional view showing a part of a cigarette according to a second embodiment of the present invention in which a flavor-containing capsule is included in a filter.
Figure 4:
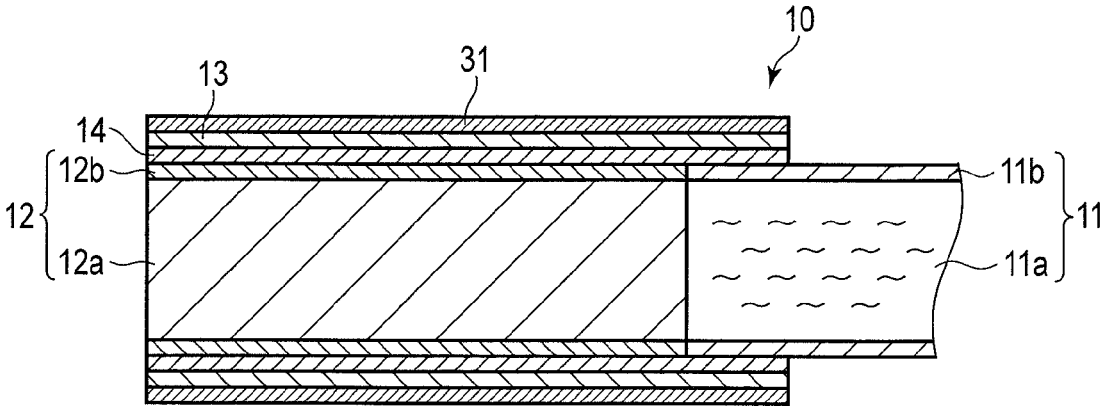
FIG. 4 is a cross-sectional view showing a part of a cigarette according to a third embodiment of the present invention in which a flavor capsule-containing layer is included on a tipping member.

An embodiment in which the flavor-containing capsule is included in the filter is shown in FIG. 3 as a second embodiment; and an embodiment in which the flavor-containing capsule is included on the tipping member is shown in FIG. 4 as a third embodiment. FIG. 3 and FIG. 4 are cross-sectional views showing a part of cigarettes according to the second embodiment and the third embodiment, respectively, wherein the same reference number is applied to an element corresponding to the element in FIG. 1, and its explanation is omitted.

The cigarette shown in FIG. 3 comprises:

a tobacco rod 11 comprising a tobacco filler 11*a* and a cigarette paper 11*b* which is wrapped around the tobacco filler 11*a;* a filter 12 comprising a filter member 12*a* in which a flavor-containing capsule 21 is embedded and a filter wrapping paper 12*b* which is integrally wrapped around the filter member 12*a*; and a tipping member 13 which is bonded onto the tobacco rod and the filter with a pressure-sensitive adhesive 14 so that the tobacco rod 11 and the filter 12 are connected to each other.

The flavor-containing capsule 21 has a structure in which a flavor component-containing solution is enclosed with a film. The size of the flavor-containing capsule 21 may be from 2 to 5 mm in a diameter. A method for preparing the flavor-containing capsule is not particularly limited, and for example, a dropping method is preferably employed, because it enables the preparation of a flavor-containing capsule having a seamless film. This method can be performed by using a double nozzle, and simultaneously discharging the flavor-containing solution from an inner nozzle and a liquid film substance from an outer nozzle. The flavor-containing capsule 21 may be embedded in the filter member 12*a* in accordance with a known technique, or the flavor-containing capsule may be located in a hollow part between two filter plugs forming the filter member, the two filter plugs being separated from each other and placed to provide the hollow part therebetween. As the flavor, for example, menthol, essential oil from plants, and the like can be used. The flavor-containing solution may further contain a solvent, a colorant and other additives such as an emulsifier. As the solvent in the flavor-containing solution, for example, medium-chain triglyceride (MCT) can be used. As the film for the flavor-containing capsule, for example, starch, dextrin, polysaccharide, agar, gellan gum, gelatin, carrageenan, various natural gelling agents, glycerol, various waxes, sorbitol, calcium chloride, and the like can be used, and it can further contain a flavor or a colorant.

It is a known technique to prepare such a flavor-containing capsule and incorporate it into the filter. However, because the components forming the film of the flavor-containing capsule are thermally unstable, if they are subjected to a heating process in accordance with a conventional method for producing a cigarette, the capsule is likely to be broken and the flavor is likely to leach from the film. According to the present invention, however, they are not subjected to the heating process during the production, and thus there is an advantage in which the flavor-containing capsule can be stably maintained.

The cigarette shown in FIG. 4 comprises:

a tobacco rod 11 comprising a tobacco filler 11*a* and a cigarette paper 11*b* which is wrapped around the tobacco filler 11*a;* a filter 12 comprising a filter member 12*a* and a filter wrapping paper 12*b* which is integrally wrapped around the filter member 12*a*; and a tipping member 13 which is bonded onto the tobacco rod and the filter with a pressure-sensitive adhesive 14 so that the tobacco rod 11 and the filter 12 are connected to each other, and which comprises a flavor microcapsule-containing layer 31 on its surface.

The flavor microcapsule-containing layer 31 is a layer obtained by coating the tipping member with slurry containing flavor-containing microcapsules (which is referred to as "microcapsule slurry"), and drying it. The size of the microcapsule may be from 3 to 25 μm in a diameter, and the thickness of the flavor microcapsule-containing layer 31 may be from 3 to 50 μm. The flavor microcapsule-containing layer can be formed on the tipping member by coating the tipping member with the microcapsule slurry, and subjecting it to natural air-drying or sending air to it at a room temperature to remove the solvent from the slurry, in accordance with a known technique. The flavor microcapsule-containing layer 31 may be formed on the entire surface of the tipping member, or at only a mouthpiece side on the surface of the tipping member. As the flavor, menthol, essential oil from plants, and the like can be used. The flavor-containing solution in the microcapsule may further contain a solvent, a colorant, and other additives such as an emulsifier. As the film for the microcapsule, for example, gelatin, agar, carrageenan, dextrin, various natural gelling agents, various waxes, and the like can be used.

It is a known technique to prepare such microcapsule slurry and form the flavor microcapsule-containing layer on the surface of the tipping paper. However, because the components forming the film of the microcapsule are thermally unstable, if they are subjected to a heating process in accordance with a conventional method for producing a cigarette, the capsule is likely to be broken and the flavor is likely to leach from the film. According to the present invention, however, they are not subjected to the heating process during the production, and thus there is an advantage in which the microcapsules can be stably maintained.

2. Method for Producing Cigarette

The cigarette of the present invention can be produced in any method so long as the tipping member is wrapped around the filter and the tobacco rod, and bonded thereto with the pressure-sensitive adhesive. Preferably, it can be produced by previously preparing a tipping member having a pressure-sensitive adhesive on its back surface (back surface-adhesive tipping member), and connecting the tobacco rod and the filter to each other using the back surface-adhesive tipping member.

In a preferable embodiment, the method for producing the cigarette of the present invention comprises:

(1) preparing a tipping member which comprises a pressure-sensitive adhesive and a release liner for protecting the pressure-sensitive adhesive, on its back surface;

(2) exposing the pressure-sensitive adhesive by releasing the release liner from the tipping member;

(3) cutting the pressure-sensitive adhesive-exposed tipping member into a size suitable for rolling the cigarette; and (4) wrapping the tobacco rod and the filter in the cut tipping member to connect them.

Figure 5:
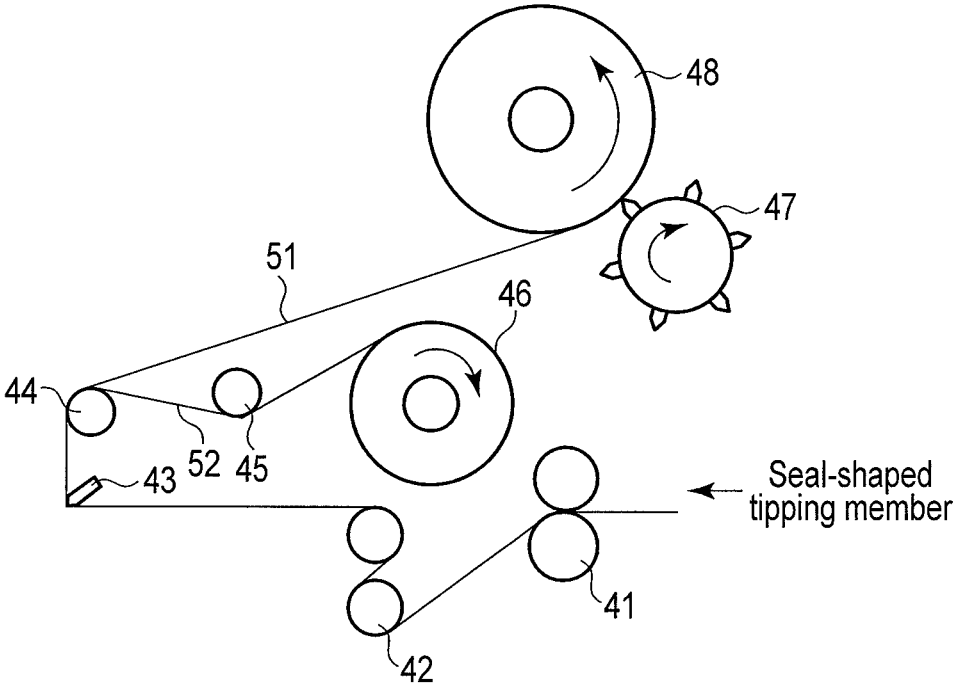
FIG. 5 is a view schematically showing one example of a system for supplying a back surface-adhesive tipping member used in a cigarette rolling process.

FIG. 5 schematically shows one example of systematization of the steps (2) and (3) described above, i.e., the system for supplying the back surface-adhesive tipping member used in the cigarette rolling process.

Figure 6:
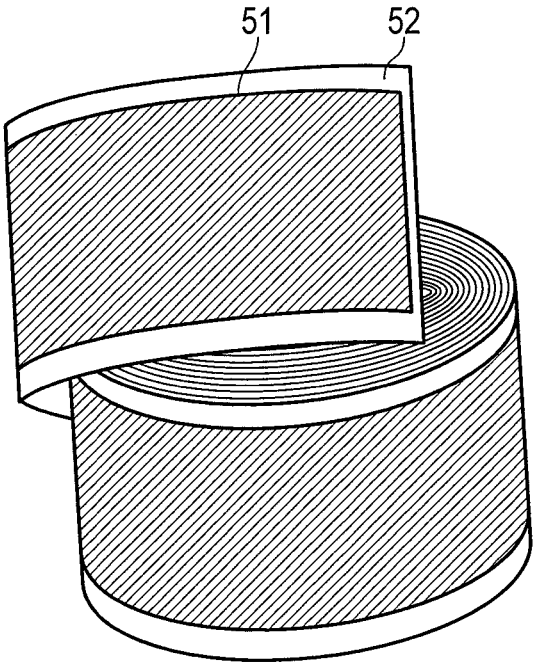
FIG. 6 is a view showing one example of a tipping member comprising a pressure-sensitive adhesive and a release liner for protecting the pressure-sensitive adhesive, on its back surface.

In the step (1) described above, a tipping member is prepared which comprises, on its back surface, a pressure-sensitive adhesive and a release liner for protecting the pressure-sensitive adhesive. FIG. 6 shows one example of a tipping member prepared in the step (1). In FIG. 6, a tipping member 51 has a pressure-sensitive adhesive (not shown in the figure) and a release liner 52 for protecting the pressure-sensitive adhesive, on its back surface, and has a shape of a seal. The tipping member 51 in FIG. 6 may have a size of 40 to 100 mm×500 to 5000 m, and the release liner 52 can have a size equal to or one size larger than the size of the tipping member 51 as shown in FIG. 6.

Such a seal-shaped tipping member can be put in a system shown in FIG. 5. In FIG. 5, the seal-shaped tipping member is sent to a position of a carrying guide 43 through rollers 41 and 42 for supplying a tipping member, and then it is carried upward through the carrying guide 43. After that, only a release liner 52 of the seal-shaped tipping member is peeled off therefrom at a position of a fixed guide roller 44. The release liner 52 peeled off at the position of the fixed guide roller 44 is rewound around a rewinding reel 46 by the actions of a releasing roller 45 the rewinding reel 46 which rotates in the direction of the arrow. On the other hand, the tipping member 51, which has the pressure-sensitive adhesive exposed at the position of the fixed guide roller 44, is sent to between a cutting knife 47 and a cutting drum 48. When the tipping member passes through between the cutting knife 47 and the cutting drum 48 which rotate in the direction of the arrow, it is cut with the cutting knife 47 on the cutting drum 48 into a size suitable for rolling the cigarette (for example, a size of 40 to 100 mm (length in axial direction of tobacco rod)×15 to 30 mm). The cut tipping member is moved to a rolling system of the cigarette (not shown in the figure).

As described above, the method for producing the cigarette of the present invention does not include a step of transferring a heat-sensitive or solvent-evaporative paste or a step of drying the paste, and thus the system shown in FIG. 5 does not require a paste-transfer roller or a heater. For that reason, the tipping member put in the system shown in FIG. 5 can be stably maintained, even if it is formed from a material unstable to a heat-sensitive or solvent-evaporative paste, or a heat-unstable material. In addition, when the seal-shaped tipping member shown in FIG. 6 is put in the system shown in FIG. 5, the back surface-adhesive tipping member, which is used in the rolling step of the cigarette, can be easily provided in a short time. Further, the method of the present invention does not use the heat-sensitive or solvent-evaporative paste, and thus a fixed amount of an adhesive can be added to each cigarette, without occurrence of a problem of variation of the paste amount or a problem of paste scales, as caused in conventional methods.

EXAMPLES

Example 1

Cigarette Having Tipping Member Bonded with Pressure-Sensitive Adhesive

A cigarette sample was produced using the following polymer film as a tipping member.

TABLE 2

| Film Main Materials | Film Name | Maker | Melting Point |
|---|---|---|---|
| Polypropylene | OP Biaxially-oriented Polypropylene General Grade OP U-1 | Mitsui Chemicals Tohcello, Inc. | About 160° C. |
| Polypropylene | CP Cast Polypropylene General Grade Homo SC | Mitsui Chemicals Tohcello, Inc. | About 160° C. |
| Polyethylene Terephthalate | Maxbarrier R | Mitsui Chemicals Tohcello, Inc. | About 255° C. |
| Polylactic Acid | Palgreen LC | Mitsui Chemicals Tohcello, Inc. | About 165° C. |
| Polyethylene | TUX L-LDPE FC-S | Mitsui Chemicals Tohcello, Inc. | About 110° C. |
| Polyethylene | ECO-BW | Futamura Chemical Co., Ltd. | About 160° C. |
| Polypropylene | PP3KZ | Futamura Chemical Co., Ltd. | About 160° C. |
| Polypropylene | FOS | Futamura Chemical Co., Ltd. | About 160° C. |
| Polypropylene | FOA | Futamura Chemical Co., Ltd. | About 160° C. |
| Polyethylene Terephthalate | FE2001 | Futamura Chemical Co., Ltd. | About 260° C. |
| Polyethylene | PE3K-H | Futamura Chemical Co., Ltd. | About 125° C. |
| Polyethylene | LL-XHT | Futamura Chemical Co., Ltd. | About 125° C. |
| Polyethylene | LL-XUMN | Futamura Chemical Co., Ltd. | About 85° C. |
| Polypropylene | FHK2 | Futamura Chemical Co., Ltd. | About 125° C. |
| Polypropylene | FAK | Futamura Chemical Co., Ltd. | About 160° C. |

As a pressure-sensitive adhesive, an acrylic double-sided adhesive tape (No. 501 L) or a rubber double-sided adhesive tape (VR-5321), manufactured by Nitto Denko Corporation, was used. The polymer film described above was cut into a size of 3.0 (length in axial direction of tobacco rod)×3.5 cm, and the double-sided adhesive tape is cut into a size of 3.0 cm×3.5 cm. The polymer film was stuck on the double-sided adhesive tape so that they overlapped each other to produce a back surface-adhesive tipping member with the release paper. The back surface-adhesive tipping member was wrapped around a filter (manufactured by our company) and a tobacco rod (manufactured by our company) while peeling off the release paper so that the filter and the tobacco rod were connect to each other (see FIG. 1).

In the cigarette of the present invention, the pressure-sensitive adhesive was used, and therefore a heating procedure was not required in its production process. As a result, any material including a material unstable to a heat-sensitive or solvent-evaporative paste or a heat-unstable material could be stably used as the tipping member.

Example 2

Cigarette Having Tipping Member Bonded with Pressure-Sensitive Adhesive and Including Flavor Microcapsule-Containing Layer on its Surface (1) Preparation of Tipping Member Including Flavor Microcapsule-Containing Layer on Its Surface A plain paper having a thickness of about 40 μm and a basis weight of 37 gsm (a base sheet for a tipping paper, manufactured by Oji F-Tex Co., Ltd.), which had been cut into a size of 5.0 cm (length in axial direction of tobacco rod)×3.0 cm, was used as a tipping member.

Slurry containing flavor microcapsules (particle size of 3 to 25 μm) was prepared from gelatin and a flavor (peppermint oil) in water in accordance with a conventional liquid-phase method. The prepared microcapsule slurry was spray-coated on one surface of the tipping paper in an amount of 2 to 5 gsm (g/m$^2$), and it was subjected to natural air-drying to fix it. Thus, the flavor microcapsule-containing layer was formed on the surface of the tipping paper.

(2) Production of Cigarette

In Example of the present invention, an acrylic double-sided adhesive tape (No. 501 L) manufactured by Nitto Denko Corporation was used as a pressure-sensitive adhesive. In Comparative Example, an aqueous emulsion (vinyl acetate, a moisture content of about 55%, Tobacall VP 7915S, Henkel Japan), which was a heat-sensitive adhesive, was used.

In Example of the present invention, the double-sided adhesive tape was cut into the same size as that of the tipping paper (5.0×3.0 cm), and it was stuck on a back surface of the tipping paper prepared in (1) (a surface having no flavor microcapsule-containing layer) so that the double-sided adhesive tape was overlapped with the tipping paper to produce a back surface-adhesive tipping paper with the release paper. The back surface-adhesive tipping paper was wrapped around a filter and a tobacco rod while peeling off the release paper so that the filter and the tobacco rod were connected to each other.

In Comparative Example, a back surface of the tipping paper prepared in (1) was coated with the aqueous emulsion to produce a back surface-adhesive tipping paper. The coated amount was about 0.1 g/piece. The back surface-adhesive tipping paper was wrapped around a filter and a tobacco rod so that the filter and the tobacco rod were connected to each other. After the tipping paper was wrapped, the resulting cigarette was rolled on a hot plate at a temperature of about 200° C. for 0.3 seconds to bond the tipping paper with heating, as a usual method for producing a cigarette.

As a filter, a plain filter (length×circumference=27×24.5 mm) was used, in which acetate tows were wrapped in a filter wrapping paper made of plain paper. As a tobacco rod, a tobacco rod of Mild Seven Super Light (length×circumference=57×24.8 mm) was used.

(3) Evaluation

The cigarettes produced in (2) were enclosed in a zippered aluminum bag (a laminated material in which PET/aluminum/PE were laminated in this order from the outside, Lamizip Stand type AL-14, manufactured by Seisannipponsha Ltd.; height×width+gusset=200×140+41 mm), immediately after the production. Ten cigarettes were enclosed in one zippered aluminum bag, which was used as one sample. Six cigarette samples were prepared for Example of the present invention and Comparative Example, respectively.

After the sample was allowed to stand at 22° C. for 24 hours, a sensory evaluation of odor strength of the flavor in the zippered bag was performed. It is possible to evaluate the stability of the capsule by the sensory evaluation of the odor strength of the flavor, because the gelatin capsule releases the flavor when the capsule is broken.

The sensory evaluation was performed by a pair test of the odor strength of the flavor in the zippered bag of Example of the present invention and the odor strength of the flavor in the zippered bag in Comparative Example.

The evaluation was performed by seven persons who did not engage in smoking flavor-related occupations in our company.

The results of the sensory evaluation are shown in Table below.

TABLE 3

| The odor in Example of the present invention is stronger | The odor in Comparative Example is stronger |
|---|---|
| 0 | 7 |

(n = 7)

Table 3 shows that the odor was significantly stronger in Comparative Example (significance level of 5%). From this result, it was shown that in the cigarettes in Comparative Example, the flavor component was leached from the capsule, and it could not be stably maintained; whereas, in the cigarettes of the present invention, the gelatin microcapsule containing the flavor could be stably maintained on the surface of the tipping paper, and they have significantly higher flavor retaining property than the cigarettes in Comparative Example.

As described above, in the cigarette of the present invention, the tipping member is bonded with the pressure-sensitive adhesive, and thus a heating procedure is not required in its production process, and any material can be incorporated into the filter or attached on the surface of the tipping member as the flavor-containing capsule.

The cigarette of the present invention, consequently, can ease restriction on materials which can be used as the tipping member and materials which can be used as the flavor-containing capsule, and thereby can impart various sense of touch and functions to the cigarette.

DESCRIPTION OF REFERENCE NUMBERS

10: Cigarette
11: Tobacco rod
11*a*: Tobacco filler
11*b*: Cigarette paper
12: Filter
12*a*: Filter member
12*b*: Filter wrapping paper
13: Tipping member
14: Pressure-sensitive adhesive
14*a*: Substrate
14*b*: First pressure-sensitive adhesive
14*c*: Second pressure-sensitive adhesive
21: Flavor-containing capsule
31: Flavor microcapsule-containing layer
41: Roller for supplying a tipping member
42: Roller for supplying a tipping member
43: Carrying guide
44: Fixed guide roller
45: Releasing roller
46: Rewinding reel
47: Cutting knife
48: Cutting drum
51: Tipping member
52: Release liner

What is claimed is:

1. A cigarette comprising:

a tobacco rod comprising a tobacco filler and a cigarette paper which is wrapped around the tobacco filler, the tobacco rod having first and second ends;

a filter comprising a filter member and a filter wrapping paper which is integrally wrapped around the filter member, the filter being adjacent to the first end;

a tipping member surrounding the tobacco rod and the filter at the first end to connect the tobacco rod and the filter; and a pressure-sensitive adhesive member having a three-layer structure consisting of a substrate, a first pressure-sensitive adhesive layer which covers one surface of the substrate and a second pressure-sensitive adhesive layer which covers the other surface of the substrate, the pressure-sensitive adhesive member being disposed between the tobacco rod and the tipping member and between the filter and the tipping member, and the pressure-sensitive adhesive member being in direct contact with the tobacco rod, the filter and the tipping member to integrate the tobacco rod, the filter and the tipping member into one piece.

2. The cigarette according to claim 1, wherein the tipping member consists of a material having a melting point of 240° C. or less.

3. The cigarette according to claim 1, wherein the cigarette further comprises a flavor-containing capsule in the filter.

4. The cigarette according to claim 1, wherein the cigarette further comprises a flavor-containing capsule on the tipping member.

5. A method for producing the cigarette according to claim 1, which comprises:

preparing a tipping member which comprises a pressure-sensitive adhesive and a release liner for protecting the pressure-sensitive adhesive, on the back surface of the tipping member;

exposing the pressure-sensitive adhesive by releasing the release liner from the tipping member;

cutting the pressure-sensitive adhesive-exposed tipping member into a size suitable for rolling the cigarette; and wrapping the tobacco rod and the filter in the cut tipping member to connect them.

6. A cigarette comprising:

a tobacco rod comprising a tobacco filler and a cigarette paper which is wrapped around the tobacco filler, the tobacco rod having first and second ends;

a filter comprising a filter member and a filter wrapping paper which is integrally wrapped around the filter member, the filter being adjacent to the first end;

a tipping member surrounding the tobacco rod and the filter at the first end to connect the tobacco rod and the fi1ter; and pressure-sensitive adhesive member having a three-layer structure consisting of a substrate, a first pressure-sensitive adhesive layer which covers one surface of the substrate, and a second pressure-sensitive adhesive layer which covers the other surface of the substrate, the pressure-sensitive adhesive member being disposed between the tobacco rod and the tipping member and between the filter and the tipping member, and the pressure-sensitive adhesive member being in direct contact with the tobacca rod, the filter and the tipping member to integrate the tobacco rod, the filter and the tipping member into one piece, wherein the cigarette is produced by the method according to claim 5.

* * * * *